US011415939B2

(12) United States Patent
Zanesco et al.

(10) Patent No.: US 11,415,939 B2
(45) Date of Patent: Aug. 16, 2022

(54) DEVICE FOR CONTROLLING THE FUNCTIONS OF A WATCH

(71) Applicant: ETA SA Manufacture Horlogère Suisse, Grenchen (CH)

(72) Inventors: Vittorio Zanesco, Neuchatel (CH); Damien Porcherie, Vesancy (FR); Louis Hêche, Delemont (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 17/159,227

(22) Filed: Jan. 27, 2021

(65) Prior Publication Data

US 2021/0311434 A1 Oct. 7, 2021

(30) Foreign Application Priority Data

Apr. 6, 2020 (EP) ..... 20168217

(51) Int. Cl.
*G04B 3/04* (2006.01)

(52) U.S. Cl.
CPC ..... *G04B 3/041* (2013.01); *G04B 3/046* (2013.01)

(58) Field of Classification Search
CPC ..... G04C 3/005; G04C 3/007; G04C 3/001; G04B 3/041; G04B 3/046; G04B 27/002; G04B 27/04; G01D 5/347; G04G 5/04
USPC ..... 368/319
See application file for complete search history.

(56) References Cited

U.S. PATENT DOCUMENTS 3,972,177 A 8/1976 Vuilleumier
3,975,897 A 8/1976 Naito
6,896,403 B1 * 5/2005 Grau ..... G04C 3/005 368/190
9,620,312 B2 * 4/2017 Ely ..... H01H 25/008
10,203,662 B1 * 2/2019 Lin ..... G01D 5/30
11,194,298 B2 * 12/2021 Roach ..... G04B 3/046
(Continued)

FOREIGN PATENT DOCUMENTS

CH 592 328 B5 10/1977
EP 3 015 925 A1 5/2016
(Continued)

OTHER PUBLICATIONS

European Search Report dated Sep. 2, 2020 in European Application 20168217.6 filed Apr. 6, 2020 (with English Translation of Categories of Cited Documents), 3 pages.

*Primary Examiner* — Edwin A. Leon
(74) *Attorney, Agent, or Firm* — Oblon, McClelland, Maier & Neustadt, L.L.P.

(57) ABSTRACT

A device for controlling the functions of a watch, which includes a crown connected to a stem, an optical action system actuated in one position of the stem from among three possible positions to determine the direction of rotation of the stem, and an electronic mechanical arrangement for controlling the functions. A guide element can rotate on a support and which has a rounded end in an annular groove of the stem to be driven in rotation, and a selection part can rotate on the support above the annular groove to be driven in rotation. The selection part includes at least one contactor for contacting a first electrical terminal on a printed circuit board in a first position of the stem, with no electrical contact in a second position of the stem, and for contacting a second electrical terminal in a third position of the stem.

16 Claims, 6 Drawing Sheets

(56) References Cited

U.S. PATENT DOCUMENTS

| | | | | |
|---|---|---|---|---|
| 2016/0116306 | A1 | 4/2016 | Ferri et al. | |
| 2017/0307414 | A1* | 10/2017 | Ferri | H03K 17/975 |

FOREIGN PATENT DOCUMENTS

| | | | |
|---|---|---|---|
| GB | 1 471 834 | A | 4/1977 |
| JP | 58-198785 | A | 11/1983 |

* cited by examiner

DEVICE FOR CONTROLLING THE FUNCTIONS OF A WATCH

CROSS-REFERENCE TO RELATED APPLICATION

This application claims priority to European Patent Application No. 20168217.6 filed on Apr. 6, 2020, the entire disclosure of which is hereby incorporated herein by reference.

FIELD OF THE INVENTION

The invention relates to a device for controlling the functions of a watch. The control device comprises a crown and a stem connected to the crown arranged on an outer side of a watch case. The stem acts on means of the control device disposed inside the watch case, to activate or select one or more functions.

BACKGROUND OF THE INVENTION

Generally, a control device, which comprises an electronic crown connected to a stem, is of relatively large size and has only two action positions, namely a rest position and a position for controlling at least one function to be performed. It is sought to produce a small control device of this type which can easily be integrated in a small watch calibre and has more than two positions for controlling functions to be performed.

U.S. Pat. No. 10,203,662 B1 discloses an electronic device, which comprises a crown connected to a watch stem. This electronic device comprises a light source for transmitting light beams onto an inclined end surface of the stem inside the watch. The light beams are reflected and sent to photoreceptors. However, there is no mention of the action of other control members, particularly connected to the stem, to perform functions in more than two control positions of the stem.

It is thus an object of the present invention to overcome the problems identified above relating to a device for controlling the functions of a watch.

SUMMARY OF THE INVENTION

The present invention therefore proposes a device for controlling the functions of a watch, as explained in more detail below, by using optical and electronic means to execute functions. Moreover, the control device is devised to be easy to integrate in the mechanical or electromechanical watch movement.

To this end, the present invention concerns a device for controlling the functions of a watch according to the independent claim 1.

One advantage of the device for controlling watch functions lies in the fact that the device is designed with elements requiring little space, especially heightwise, so that it is ultra flat and easy to integrate in a small calibre watch while maintaining a traditional casing method.

Advantageously, the device mainly comprises a crown connected to a stem, which can be moved preferably in a rectilinear direction to occupy three determined positions T0, T1 and T2 in order to actuate at least one and preferably at least two electrical contactors of an electronic mechanical assembly, and an inner end to act on an optical action system for determining the direction of rotation of the stem. A selection part, notably made of metal, is mounted to rotate about a rotating arbor fixed on a support, and is driven in rotation by a guide element, such as a pull-out piece, mounted to rotate about another arbor on the support. This guide element has a rounded end moving in a circular groove of the stem in order to be moved, depending on the position of the stem, from one position to another position and to allow the two contactors of the selection part to contact either a first electrical terminal or a second electrical terminal or no electrical terminal defining one of the positions of the stem. The electrical contact at one or other of the electrical terminals controls each switch or micro-switch connected to each electrical terminal. Preferably, the electrical contact of one of the contactors at one of the electrical terminals is an earthing contact like with the bottom plate bearing the watch movement. However, the electrical contact could also be linked to the supply voltage particularly from a battery powering the watch.

Advantageously, the optical system comprises a coded disc, which is mounted to rotate in a plastic frame or cover and driven in rotation in the third position T2 of the stem, and two photo-reflectors arranged opposite the disc. The disc of a light absorbent base material either has through openings, preferably evenly distributed and spaced to reflect light on a reflective surface of the cover above the openings, or sectors reflecting light on the surface of the disc, which are evenly distributed and spaced. Each photo-reflector, placed in well defined positions on a printed circuit board, transmits light to the disc and detects the reflected light to obtain two quadrature signals determining the direction of rotation.

The optical system is more advantageous than a magnetic solution since it uses less space.

Thus, the mechanical elements for actuating the contactors, the switches or interrupters and the optical detection disc are in one plane, take up little space in height and are therefore ultra flat. It is possible to obtain a height of around 3 mm for the calibre comprising the watch movement with the function control device.

Other aspects of the present invention are defined in the dependent claims.

BRIEF DESCRIPTION OF THE DRAWINGS

The objects, advantages and features of a device for controlling the functions of a watch will appear more clearly in the following non-limiting description with reference to the drawings, in which.

DETAILED DESCRIPTION OF THE INVENTION

In the following description, all the components of a device for controlling the functions of a watch that are well known to those skilled in the art in this technical field will be described only in a simplified manner. The function control device mainly comprises a crown connected to a stem actuating means for selecting functions in the watch. The watch may be an electromechanical watch or a mechanical watch. A 'function' means any operation performed in the watch changing, for example, the time or date indication, or to perform measurements via one or more sensors, or other functions or operations via the action of the stem connected to the crown.

Figure 1:
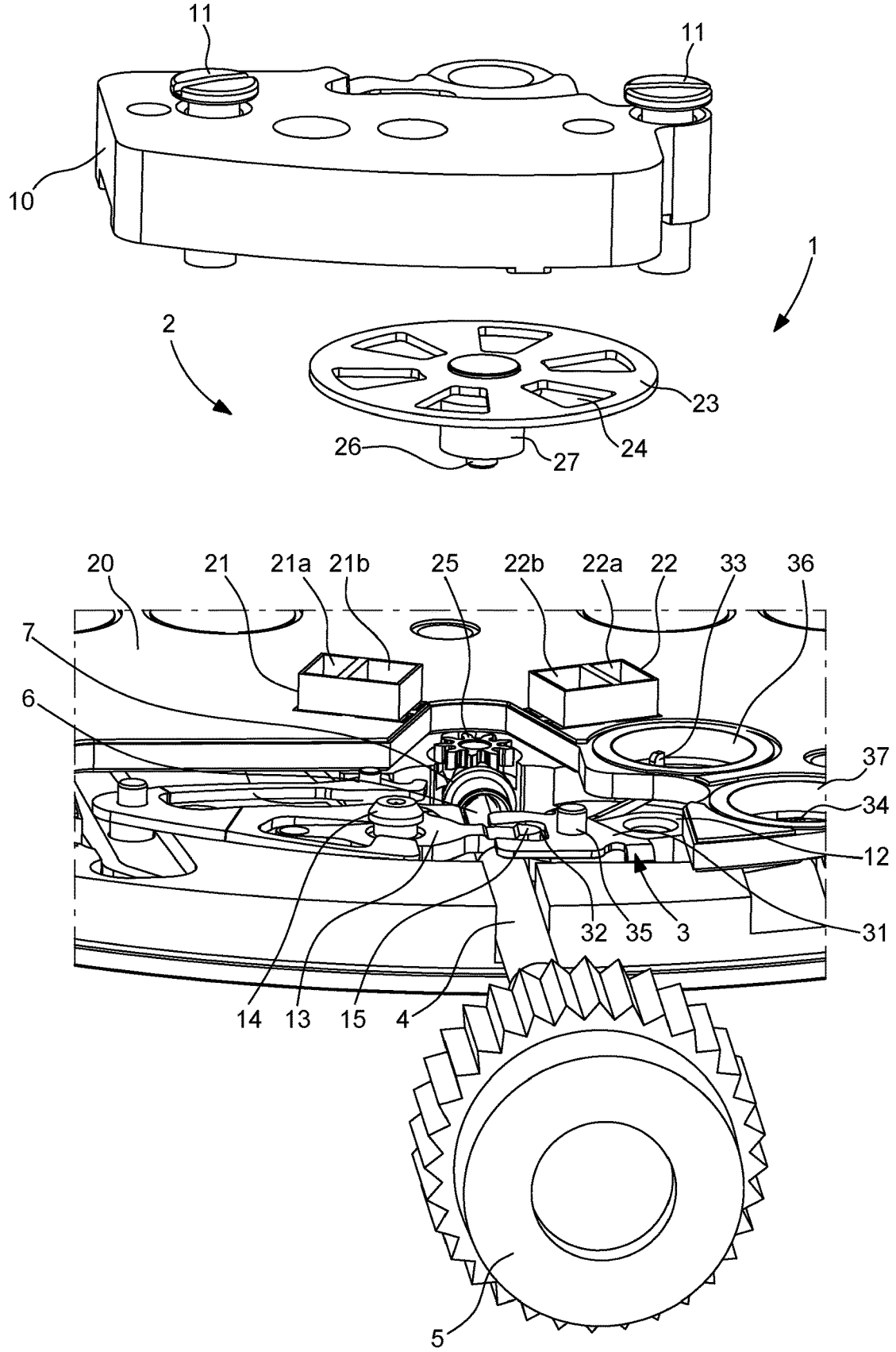
FIG. 1 shows a partially exploded three-dimensional view of a first embodiment of the device for controlling the functions of a watch according to the invention.

FIG. 1 shows a first embodiment of the function control device 1. Control device 1 mainly comprises a crown 5 connected to a stem 4, which can be moved, preferably in a rectilinear direction, to occupy one of the three determined positions referenced T0, T1, T2 in order to actuate an electronic mechanical arrangement 3 and an optical action system 2 in one of the referenced determined positions. This electronic mechanical arrangement 3 comprises at least one contactor 33 and preferably, as shown in FIG. 1, at least two contactors 33, 34 of a selection part 31, including a main, flat-shaped body mounted about an arbor 35 rotating on a support 12, generally directly connected to an assembly plate of the watch movement. Selection part 31, which may be made of a metal or electrically conductive material, is driven in rotation about its arbor 35 by a guide element 13 mounted to rotate about an arbor 14 on support 12. Guide element 13, which may be made if metal, is defined as a pull-out piece. Generally flat-shaped guide element 13 comprises a rounded end 15, which is placed in a U-shaped opening 32 of one end of the body of selection part 31, which is above a central portion of stem 4. Rounded end 15 of guide element 13, which is of greater thickness than the thickness of the U-shaped end of selection part 31, is also arranged in an annular groove made on the central portion of stem 4. Consequently, under the effect of the rectilinear movement of stem 4 in one or other of the three defined positions, guide element 13 rotates about its arbor 14 and thus drives selection part 31 in rotation about the other arbor 35 to move contactor 33 or contactors 33, 34. Guide element 13 is thus arranged beneath and parallel to the body of selection part 31, which is generally also parallel to the plane of the watch.

These contactors 33, 34 are preferably metal strips to ensure electrical contact with electrical terminals 36, 37, which are, for example, metallized holes made in a printed circuit board 20. Contactors 33, 34 are located on an opposite side to U-shaped opening 32. One end of each contactor 33, 34 is connected to the main body of selection part 31 slightly offset below the body and parallel to the body of this selection part 31, and below and parallel to printed circuit board 20. A first contactor 33 is intended to come into contact with a first electrical terminal 36 of the first metallized hole over its entire inner circular edge in a first position T0 of stem 4 pulled outwards from the watch case. A second contactor 34 is intended to come into contact with a second electrical terminal 37 of the second metallized hole over its entire inner circular edge in a third position T2 of stem 4 pushed into the watch case. In a second intermediate position T1 of stem 4, the two contactors 33, 34 are not in contact with electrical terminals 36, 37. The holes are of large enough diameter to allow sufficient travel of each end of contactors 33, 34 to come into contact with first electrical terminal 36 or with second electrical terminal 37. More details with respect to these three positions of stem 4 are explained below with reference to FIGS. 4*a*, 4*b* and 4*c*.

In position T2 of stem 4, optical action system 2 is actuated. To this end, a sliding pinion 7 is mounted at one end 6 of stem 4 for meshing with a toothed wheel 25 of optical system 2. Tubular-shaped sliding pinion 7 is fixedly mounted on inner end 6 of stem 4. This inner end 6 comprises flat outer parts for receiving the sliding pinion, which includes complementary parts inside its tubular shape thereby preventing it from rotating on inner end 6 of stem 4. The cross-section of end 6 can, for example, define a polygon, such as a square or a rectangle. Thus, the tubular interior of sliding pinion 7 can have a complementary shape to end 6. Sliding pinion 7 can be secured by any means on inner end 6 of stem 4 once it is positioned on inner end 6. This can involve bonding, brazing or a fixing screw through sliding pinion 7 and in a thread of inner end 6 of stem 4.

Optical action system 2 firstly comprises a first photo-reflector 21 and a second photo-reflector 22 which are electrically connected on printed circuit board 20. First photo-reflector 21 comprises at least one light emitting LED source in a first housing 21*a* and a photoreceptor portion in a second housing 21*b* of first photo-reflector 21. Likewise, second photo-reflector 22 comprises a light emitting LED source in a first housing 22*a* and a photoreceptor portion in a second housing 22*b* of second photo-reflector 22.

Optical action system 2 further comprises a disc 23 in which several through openings 24 are made. Disc 23 is mounted to rotate about at least one arbor arranged in a direction perpendicular to the plane of the watch. These through openings 24 are preferably evenly distributed over a circular rim inside disc 23. The shape of each through opening 24 may be an angular sector starting in proximity to the centre of the disc and in proximity to an outer rim of the disc. There may be, as indicated in FIG. 1, six angular sectors of 30° angle and each also separated by a space of 30° angle. Evidently, more or less than six angular sectors 24 can be provided without limitation, or also an arrangement of angular sectors spaced apart in a non-uniform manner around a circumference inside disc 23.

Disc 23 is fixedly mounted on a first arbor 27 having a first diameter, and a second arbor 26 having a second diameter is fixedly mounted coaxially under first arbor 27. The first diameter of first arbor 27 is greater than the second diameter of second arbor 26. Disc 23 is mounted on a toothed wheel 25 via its second arbor 26, which is inserted into a central opening in toothed wheel 25. Second arbor 26 can be inserted, for example, forcibly, into the central opening of toothed wheel 25 in order to securely attach the latter to disc 23 and to first arbor 27 and second arbor 26 so as to form a single piece capable of rotating about a central axis. Toothed wheel 25 is held on a lower support (not represented), allowing the assembly of disc 23, first arbor 27, second arbor 26 and toothed wheel 25 to rotate about a central axis.

The diameter of disc 23, which is defined as an encoder disc, is sufficiently large to cover at least partly the two photo-reflectors 21 and 22. The space separating the lower surface of disc 23 and each photo-reflector 21 and 22 is chosen to be relatively small in order to allow disc 23 with these openings 24 to act as a shutter for the light generated by the light sources of each photo-reflector 21, 22. Disc 23 and the two photo-reflectors 21 and 22 are arranged underneath a frame or cover 10, preferably made of plastic material, which is arranged to be screwed by means of screws 11 onto a support 12, which may be made of metal, directly connected to the plate of the watch movement. A reflective coating is made on an inner surface of cover 10 above disc 23 in order to reflect the light beams which are generated by each photo-reflector 21 and 22 and pass through openings 24 of disc 23. The reflective coating may be a golden layer. Disc 23 can also be made of plastic material with a coating capable of absorbing the light beams generated by photo-reflectors 21 and 22. Disc 23 can advantageously be made of a base or black material absorbing a maximum amount of light. As a result, there is less sensitivity to light variations in the light sources.

Figure 3:
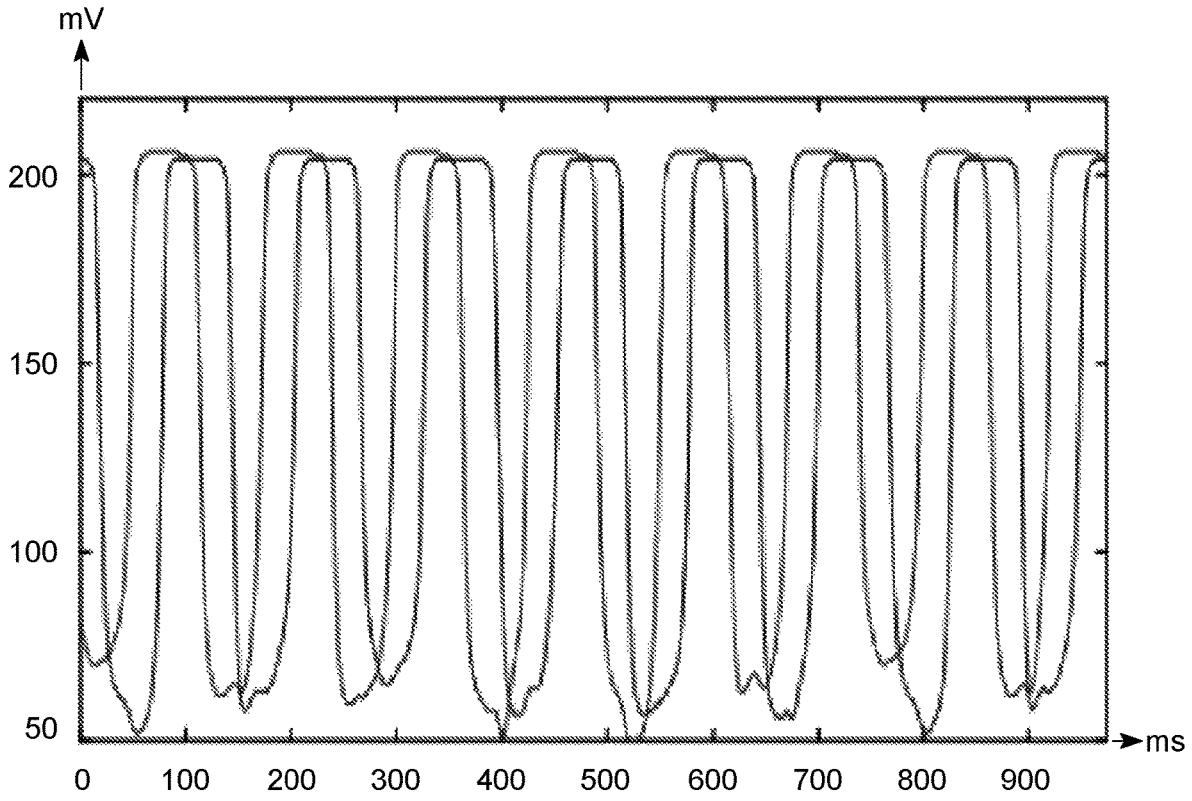
FIG. 3 represents a graph of the light signals captured by each photo-reflector showing the output signal quadrature as a function of the position of each photo-reflector with respect to a disc with an opening or with surfaces reflecting the light signals transmitted by the photo-reflectors of the device according to the invention.

It is to be noted that each photo-reflector 21 or 22 is arranged on a printed circuit board 20 in order to obtain two quadrature signals at the output of the photoreceptors of the two photo-reflectors 21 and 22. This means two signals of substantially sinusoidal shape, if the speed of rotation of the stem is more or less constant, these two signals being spaced apart 90° in time as illustrated in a basic manner in FIG. 3. The x axis of FIG. 3 indicates milliseconds, and the y axis indicates millivolts. This makes it possible to identify the direction of rotation of stem 4 when it is in third position T2 with sliding pinion 7 driving in rotation toothed wheel 25 with disc 23.

It is also to be noted that, in a variant of the first embodiment of FIG. 1, there may be only one contactor 33 in the form of a metal strip slightly offset beneath the main body of selection part 31 and beneath printed circuit board 20. A raised finger 33' may also be provided at the free end of first contactor 33, which is arranged in a single metallized hole. Contactor 33 with its raised finger 33' can come into contact on the one hand with a first electrical terminal 36 on a first metallized portion of the inner circular edge of the hole, or, on the other hand, a second electrical terminal 37 on a second metallized portion of the inner circular edge of the hole. However, this variant complicates the printed circuit board and therefore increases the production costs of such a variant. The first embodiment shown in FIG. 1 and explained above is therefore preferred.

Figure 2:
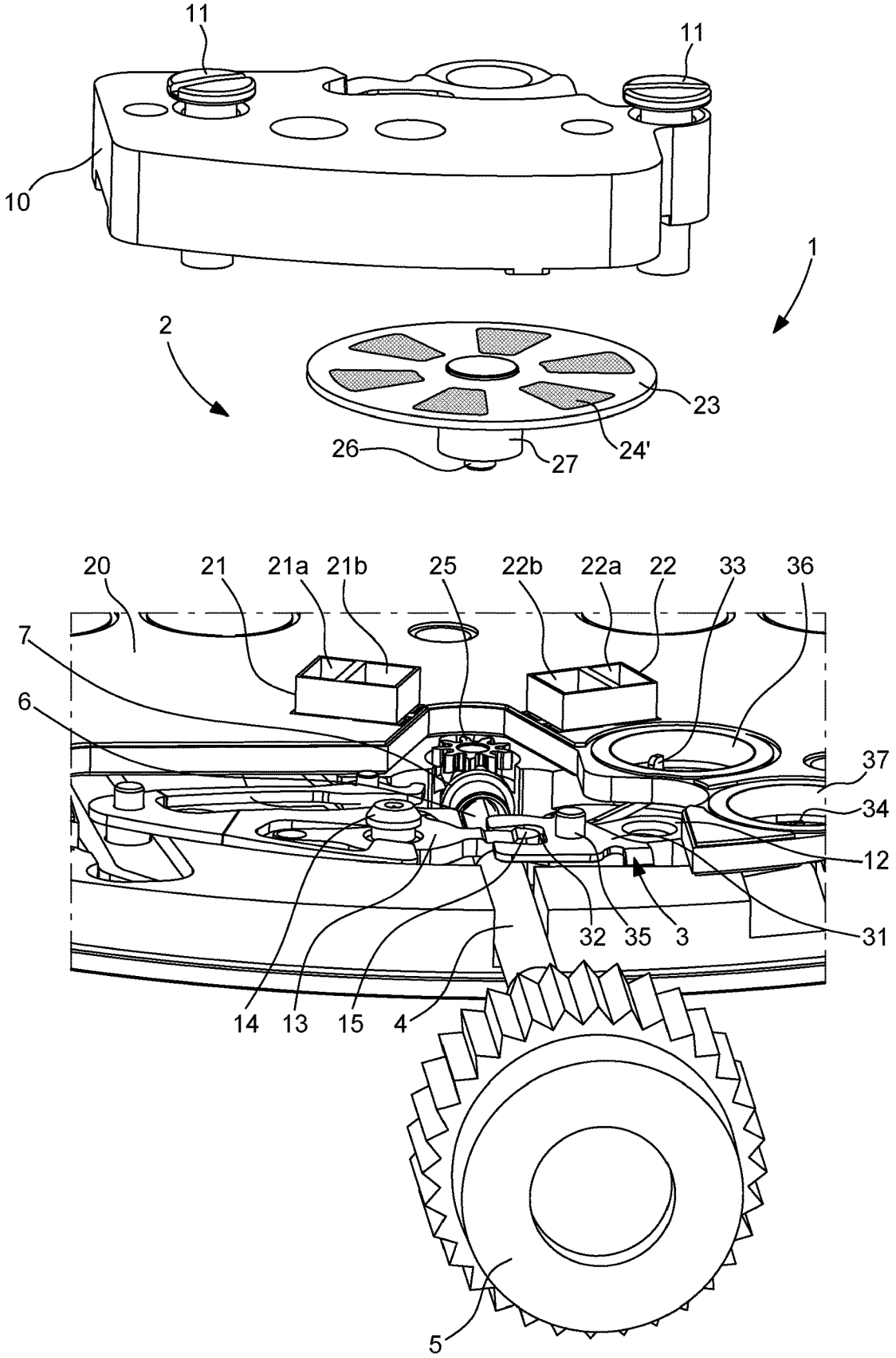
FIG. 2 shows a partially exploded three-dimensional view of a second embodiment of the device for controlling the functions of a watch according to the invention.

FIG. 2 represents a second embodiment of function control device 1. This second embodiment of function control device 1 differs from the first embodiment of device 1 described above, only with regard to optical action system 2. Optical action system 2 comprises, in this second embodiment, a disc 23, wherein the openings are replaced by reflective portions 24'. In the case of a solid disc 23, a coating of reflective portions 24' is made on a surface of disc 23 opposite photo-reflectors 21 and 22. The shape of these reflective portions 24' may be identical to the through openings of disc 23 of the first embodiment described above. It is also possible for the through openings of disc 23 of the first embodiment to be completely filled with a layer of light reflective material as more or less shown in FIG. 2. However, it is preferable simply to have a coating of reflective portions made underneath disc 23, which is entirely made of a light absorbent material or completely black material before the coating of reflective portions.

In this second embodiment of the device, disc 23 may be close to the two photo-reflectors 21 and 22, while still allowing each of them the possibility of generating a light beam able to be reflected onto reflective portions 24' of disc 23 and picked up by the photoreceptors of photo-reflectors 21 and 22. In such case, cover 10, which encloses disc 23 and photo-reflectors 21 and 22, no longer has a reflective coating on an inner surface facing disc 23. However, this cover 10 is also fixed to a support 12 of the plate by means of two screws 11 screwed into corresponding threads of support 12.

Since all the other components of this second embodiment of function control device 1 are identical to those described with reference to FIG. 1, the whole description will not therefore be repeated.

Figure 7:
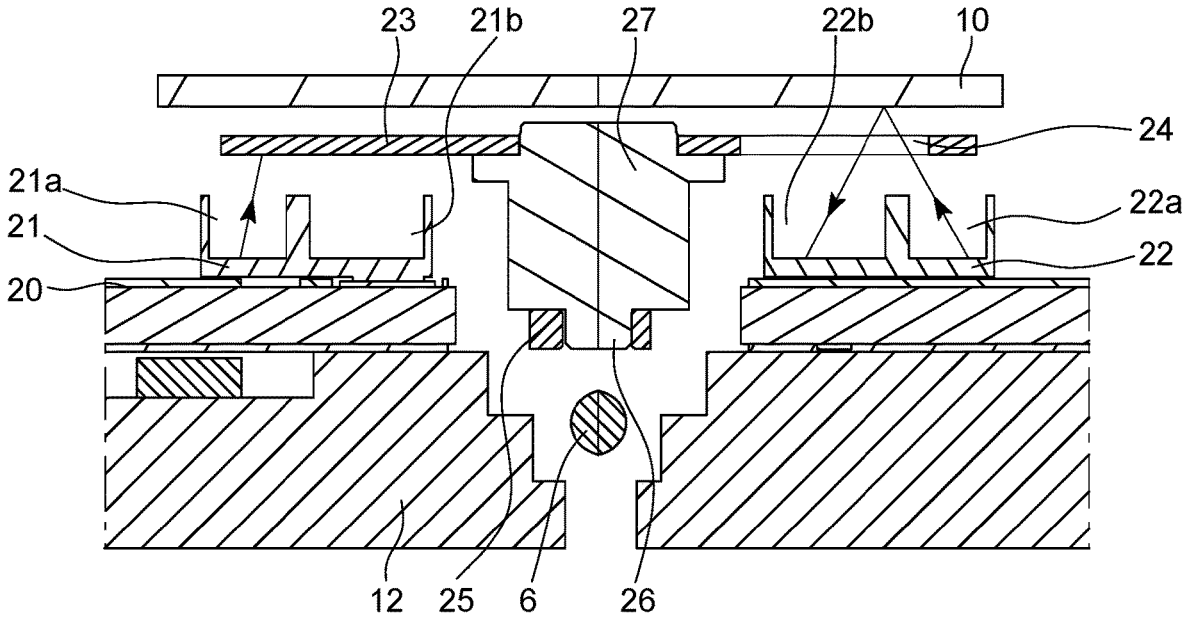
FIG. 7 shows a vertical cross-section through the optical system of the first embodiment of the function control device showing the operation of detecting the direction of rotation of the stem according to the invention.

FIG. 7 represents a vertical cross-section through the optical system of the first embodiment of the function control device showing the operation of detecting the rotational direction of the stem, end 6 of which is schematically shown. FIG. 7 shows first photo-reflector 21 and second photo-reflector 22, which are mounted on a printed circuit board 20 in which are also made the first and second metallized holes explained in more detail below. Normally, in a third position T2 of the stem, disc 23 with these through openings 24 is rotated by the drive of the sliding pinion (not represented) at inner end 6 of the stem in contact with toothed wheel 25.

First photo-reflector 21 generates a light beam in a first housing 21*a* in the direction of disc 23. Since this light beam reaches a light absorbent portion of disc 23, there is no reflection of light, and the photoreceptor in second housing 21*b* of first photo-reflector 21 does not capture any light. However, second photo-reflector 22 generates a light beam in a first housing 22*a* in the direction of disc 23, and this light beam passes through a through opening 24 and is reflected on a reflective surface under the cover. This reflected light is thus captured by the photoreceptor in second housing 22*b* of second photo-reflector 22. Depending on the positioning of the two photo-reflectors 21 and 22, the electrical output signals are quadrature signals which makes it possible to determine the direction of rotation of the stem.

Figure 4A:
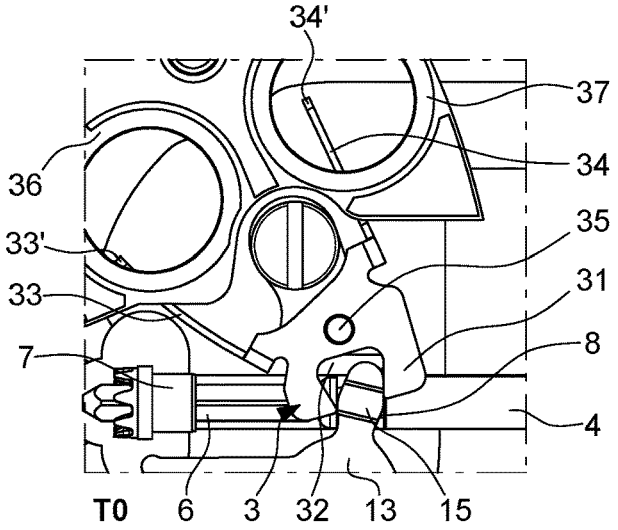
FIGS. 4*a*, 4*b*, 4*c* show a simplified top view of the three positions of movement of the stem of the device according to the invention.
Figure 4B:
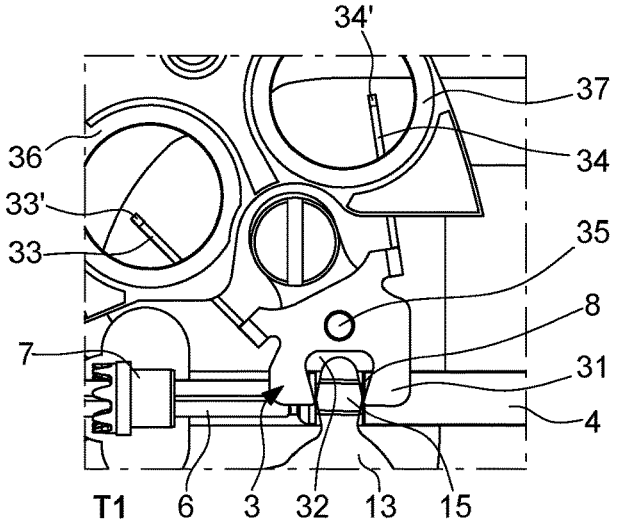
Figure 4C:
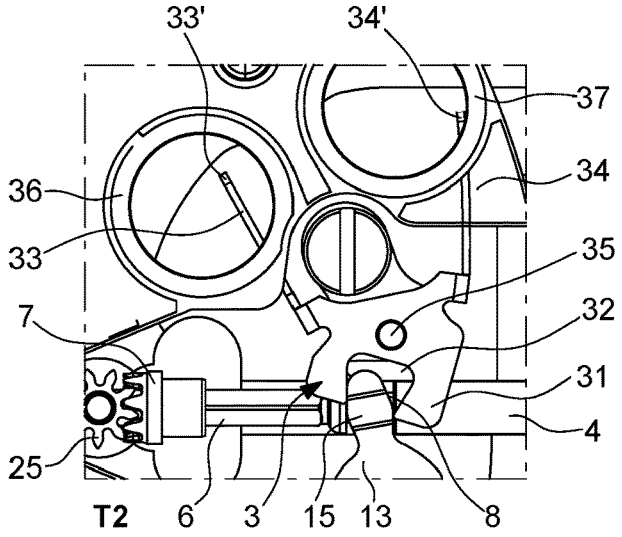

FIGS. 4*a*, 4*b* and 4*c* represent the three positions T0, T1 and T2 of stem 4 for controlling the watch functions to be executed or selected. Positions T1 and T2 are determined stable positions, and position T0 is a 'click' position which, after pressing on the crown connected to stem 4, returns to position T1. These different positions of stem 4 will also be explained more specifically in the following description of the various FIGS. 4*a*, 4*b* and 4*c*.

FIG. 4*a* represents position T0 of stem 4. Stem 4 is pulled towards the exterior of the watch case by means of the crown (not represented). Guide element 13, which is defined as the pull-out piece, is rotated towards the exterior of the watch case via its rounded end 15, which is in circular groove 8 of the intermediate portion of stem 4. Rounded end 15 of guide element 13, which is also in opening 32 of the U-shaped end of selection part 31, drives in rotation selection part 31, which rotates about the other arbor 35 in an anticlockwise direction with respect to FIG. 4*a*. Once stem 4 is in this position T0, it remains in this position temporarily.

Selection part 31 comprises a first contactor 33, which is a metal strip, which is slightly offset beneath the body of the selection part. This metal strip extends from a central portion or a body of selection part 31 towards the interior of the first metallized hole in inner edge 36. In the first metallized hole in inner edge 36, a raised finger 33' at the free end of first contactor 33 comes into direct contact with metallized inner edge 36, which defines the first electrical terminal. A switch or microswitch (not represented) is connected to the first electrical terminal in order to earth it just like the potential of the plate, or to set it to a different voltage, such as the supply voltage supplied by the battery, but which is not advantageous in this case. An electronic processing circuit of the function control device is not represented but takes account of the contact of first contactor 33 at first electrical terminal 36. In this manner, action on the crown from first position T0 instructs the electronic processing circuit to perform a particular function, notably in conjunction with the time base of the watch.

Selection part 31 comprises a second contactor 34, which is a metal strip, which is slightly offset beneath the body of the selection part 31. This metal strip extends from a central portion of selection part 31 on an opposite side to first contactor 33 towards the interior of the second metallized hole on inner edge 37. In this second metallized hole on inner edge 37, a raised finger 34' at the free end of second contactor 34 does not come into contact with metallized inner edge 37 and remains more or less in a central position in this second hole. The strip of first contactor 33 and the strip of the second contactor can be parallel to the printed circuit board and pass underneath the printed circuit board, which may also be flexible in nature.

FIG. 4*b* represents second position T1 of stem 4. Stem 4 is in a stable position which can be considered a rest position. Guide element 13 with its rounded end 15 is centred in a circular groove 8 of the central portion of stem 4. In this case, first contactor 33 and second contactor 34 do not come into contact with the first hole on metallized inner edge 36 and with the second hole on metallized inner edge 37. All the other elements described with reference to the preceding FIG. 4*a* are identical and will not therefore be repeated. The electronic processing circuit of the function control device also takes account of this second position T1 as a function of the passage from a previous position to this second position T1 as explained in more detail below.

FIG. 4*c* represents third position T2 of stem 4. Stem 4 is in a stable third position T2. Stem 4 is pulled towards the interior of the watch case by means of the crown (not represented). Guide element 13 is rotated towards the interior of the watch case via its rounded end 15, which is in circular groove 8 of the intermediate portion of stem 4. Rounded end 15 of guide element 13, which is also in opening 32 of the U-shaped end of selection part 31, drives in rotation selection part 31, which rotates about the other arbor 35, this time in a clockwise direction with respect to FIG. 4*c*. Once stem 4 is in this third position T2, it remains in this stable position.

In this third position T2, sliding pinion 7, which is fixedly mounted on inner end 6 of stem 4, meshes with toothed wheel 25 of the optical action system. Thus, by rotating the crown connected to stem 4, the disc with through openings or with reflective portions of the optical action system described with reference to FIGS. 1 and 2 above, also rotates. The two photo-reflectors of the optical system supply light signals which are partly reflected and captured by the photoreceptors of the photo-reflectors. This has the effect of providing two electrical signals at the output of the photo-reflectors making it possible to determine the direction of rotation of stem 4. The processing circuit of the function control device takes account of the direction of rotation of the stem, notably to correct the hour, minutes or seconds, or also the date.

Contrary to what was shown in FIG. 4*a* for first position T0, here it is the second contactor 34 via its finger 34', which comes into contact in the second metallized hole on inner edge 37, which forms the second electrical terminal. A switch or microswitch (not represented) is connected to the second electrical terminal in order to earth it just like the potential of the plate, or to set it to a different voltage, such as the supply voltage supplied by the battery, but which is not advantageous in this case. In the first metallized hole on inner edge 36, finger 33 of first contactor 33 does not come into contact with metallized inner edge 36 and remains more or less in a central position in this first hole.

Figure 5:
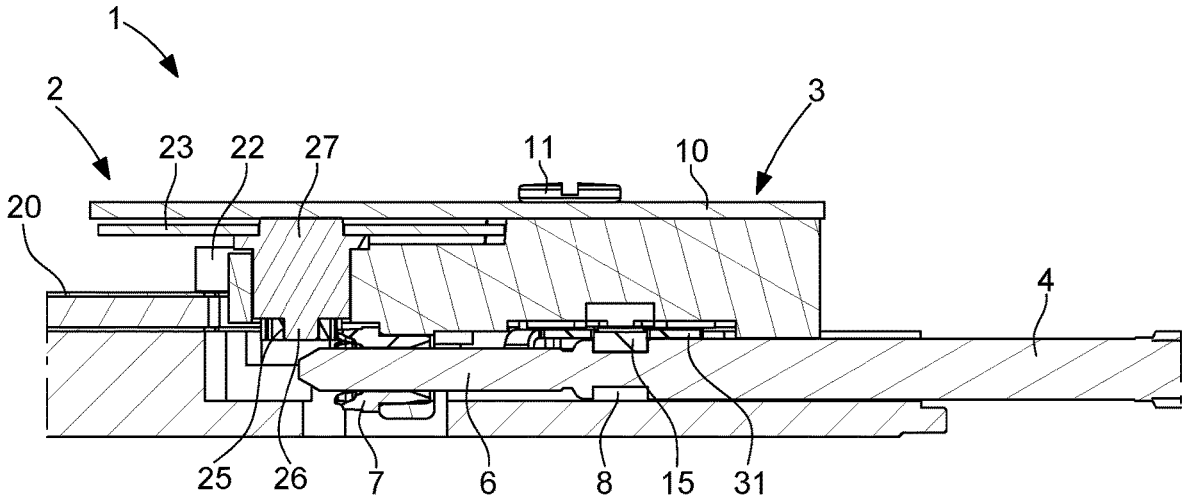
FIG. 5 shows a longitudinal cross-section along the arbor of the stem representing the function control device according to the first embodiment or the second embodiment in the third position of the stem actuating the optical system according to the invention.

FIG. 5 shows only a longitudinal cross-section along the arbor of stem 4 representing function control device 1 according to the first embodiment in third position T2 of stem 4 actuating optical system 2. So as not to repeat all the elements already described with reference to FIGS. 1 and 2, we notice mainly rounded end 15 of the guide element, which is in circular groove 8 of stem 4 and which is driven towards the interior of the watch case when stem 4 is pushed inwards. Selection part 31 is also rotated so that the second contactor (not represented) contacts the second metallized hole as explained above. Sliding pinion 7 on inner end 6 of stem 4 is meshed with toothed wheel 25 of optical system 2 to allow the rotation of disc 23 and the reflection or non-reflection of light signals generated by each photo-reflector, of which only photo-reflector 22 is shown. Cover 10 enclosing the optical system is screwed onto the support directly connected to the plate of the watch movement by means of two screws 11.

Figure 6:
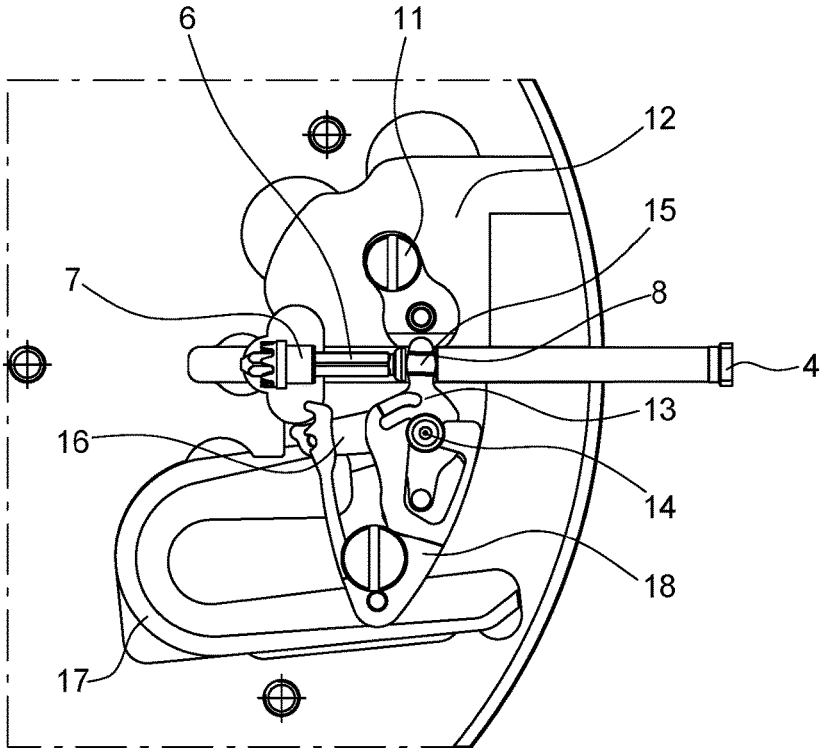
FIG. 6 shows a top view of the elements for the mechanical indexing of the stem of the function control device according to the invention.

FIG. 6 shows a top view of the elements for the mechanical indexing of stem 4 of the function control device. Guide element 13, which is defined as a pull-out piece, further comprises a side portion 16, which can mesh with a pull-out piece jumper 18 as a function of the determined position of stem 4. There is also represented a pull-out piece spring 17, which acts only when stem 4 moves from second position T1 to first position T0 and back to second position T1. In this second position T1, pull-out piece jumper 17 is not in contact with pull-out piece 13 via its side portion 16. It is positioned and prestressed by the plate.

Pull-out piece jumper 18 indexes guide element 13, which is defined as the pull-out piece, via its side portion 16 in a stable second position T1 and a stable third position T2. In first position T0, there is only the sensation of a click. Thus, pull-out piece spring 17 ensures that pull-out piece 13 returns to second position T1 following a click.

It is to be noted that, for further details on the stable positions and the click, reference can be made to the technical specification of the ETA E63.111 module without describing the whole operation in more detail in this description.

As a non-limiting example of the function control device according to the invention integrated in a watch movement, the various functions can be explained below.

To set the time and date, the crown can be pulled out to first position T0. Depending on the movement available with the calibre used, the hour hand may tick. When the crown is rotated, there may be an hour jump in one hour increment. The setting can be validated by pushing the crown into stable second position T1.

To set the seconds or minutes, the crown can be pushed into third position T2, where the sliding pinion meshes with the toothed wheel of the optical system. In this position, the seconds hand may tick. Afterwards, the crown connected to the stem is pulled out to first position T0, which results in the seconds hand being placed at 12 o'clock. The crown is then rotated, which results in a minute jump in one minute increment. Then the setting is validated by pushing the crown into the second rest position T1.

It is also to be noted that it is possible to envisage the function control device having three positions of the stem referenced T1, T2 and T3, which are stable positions, instead of having positions T0 (click), T1 (stable) and T2 (stable). Further, it is also possible for the stem of the function control device to be removable like a conventional calibre.

Evidently, other operating possibilities with the three positions of the function control device can be envisaged by those skilled in the art without departing from the scope of the invention defined by the claims.

The invention claimed is:

1. A device for controlling functions of a watch, the device comprising:

a crown connected to a stem to actuate an electronic mechanical arrangement configured to select functions in a watch case, the crown being located on an outer portion of the watch case;

integrated in a watch movement, an optical action system actuated in one position of the stem from among three possible defined positions of the stem in order to determine a direction of rotation of the stem; and the electronic mechanical arrangement to control functions in all three positions of the stem, said electronic mechanical arrangement comprising a guide element mounted to rotate about a rotating arbor on a support connected to a plate of the watch movement, the guide element being generally flat-shaped having a rounded end arranged in a circular annular groove of an intermediate portion of the stem to be driven in rotation during a movement of the stem in one or other of the three defined positions, and a selection part mounted to rotate about another rotating arbor on the support and above the annular groove of the stem and intended to be driven in rotation by the rounded end of the guide element with a thickness to be housed inside a U-shaped opening of one end of the selection part, the selection part comprising at least one electrically conductive contactor arranged on an opposite side to the U-shaped end so as to contact a first electrical terminal on a printed circuit board in a first position of the stem, to have no electrical contact in a second position of the stem, and to contact a second electrical terminal on the printed circuit board in a third position of the stem.

2. The device according to claim 1, wherein the selection part is an electrically conductive metal part, and said selection part comprises a first contactor in a form of a metal strip, one end of which is connected to a body of the metal selection part in proximity to the other rotating arbor, and another free end of the metal strip is configured to contact the first electrical terminal on a first metallized portion of an inner circular edge of a hole made through the printed circuit board in the first position of the stem, contact the second electrical terminal on a second metallized portion of the inner circular edge of the hole in the third position of the stem, or have no contact with the first electrical terminal or the second electrical terminal in the second position of the stem.

3. The device according to claim 2, wherein a body of the selection part is substantially parallel to the printed circuit board, the metal strip of the first contactor is arranged slightly offset underneath the body of the selection part and the printed circuit board, a free end of the first contactor comprises a raised finger for contacting either the first electrical terminal, or the second electrical terminal or not contacting the two electrical terminals depending on the position of the stem, and the diameter of the hole which comprises the two electrical terminals is defined as a function of the three positions of the stem and of a movement of the free end of the first contactor in each of the three positions.

4. The device according to claim 1, wherein the selection part is an electrically conductive metal part, said selection part comprises a first contactor and a second contactor which are each in a form of a metal strip, one end of the first contactor is connected to a body of the metal selection part in proximity to the other rotating arbor, whereas one end of the second contactor is connected to the body of the metal selection part on an opposite side to the other rotating arbor, another free end of the metal strip of the first contactor is configured to contact the first electrical terminal on an inner metallized edge of a first hole made through the printed circuit board in the first position of the stem, whereas the second contactor has no electrical contact in a second adjacent hole made through the printed circuit board, the second hole comprising the second electrical terminal on a metallized inner edge of said second hole, another free end of the metal strip of the second contactor is configured to contact the second electrical terminal on the metallized inner edge of said second hole in the third position of the stem, whereas the first contactor has no electrical contact in the first hole, and the first contactor and the second contactor have no electrical contact with the first electrical terminal and with the second electrical terminal in the second position of the stem.

5. The device according to claim 4, wherein the body of the selection part is substantially parallel to the printed circuit board, the metal strip of the first contactor and the metal strip of the second contactor are arranged slightly offset and underneath the selection part and the printed circuit board, the free end of the first contactor comprises a raised finger for contacting the first electrical terminal of the first hole in the first position of the stem, the free end of the second contactor comprises a raised finger for contacting the second electrical terminal of the second hole in the third position of the stem, and the diameter of the first hole and the diameter of the second hole are defined as a function of the three positions of the stem and of a movement of the free end of the first contactor and of the free end of the second contactor in each of the three positions.

6. The device according to claim 1, wherein each electrical contact of a first contactor or of the first contactor with a second contactor of the selection part against the first electrical terminal in the first position of the stem or against the second electrical terminal in the third position of the stem controls one microswitch connected to each electrical terminal in direct connection with a data processing circuit of the watch for setting various parameters, including the hour, the date, the minutes and seconds in one or other of the positions of the stem.

7. The device according to claim 1, wherein the optical action system is actuated in the third position of the stem during the rotation of the stem, the optical action system comprises a first photo-reflector and a second photo-reflector electrically connected on the printed circuit board, the first photo-reflector comprises at least one light emitting light source and one photoreceptor portion, the second photo-reflector comprises one light emitting light source and one photoreceptor portion, the optical action system further comprises a disc mounted to rotate along at least one vertical axis perpendicular to the plane of the watch, and above the photo-reflectors, the disc comprises through openings configured to allow light to pass through one or other of the through openings from the first photo-reflector and/or the second photo-reflector when said disc rotates above the photo-reflectors so that the light is reflected onto a reflective surface of a cover above the through openings of the disc, and the reflected light is captured by the photoreceptor portion of the first photo-reflector and/or of the second photo-reflector, which are arranged on the printed circuit board so as to output two quadrature signals determining the direction of rotation of the stem.

8. The device according to claim 1, wherein the optical action system is actuated in the third position of the stem during the rotation of the stem, the optical action system comprises a first photo-reflector and a second photo-reflector electrically connected on the printed circuit board, the first photo-reflector comprises at least one light emitting light source and one photoreceptor portion, the second photo-reflector comprises a light emitting light source and a photoreceptor portion, the optical action system further comprises a disc mounted to rotate along at least one vertical axis perpendicular to the plane of the watch, and above the photo-reflectors, the disc has a coating of reflective portions made on a surface of the disc opposite the photo-reflectors one or other of the reflective portions configured to reflect light from the light emitting light source of the first photo-reflector and/or of the second photo-reflector when the disc rotates above the photo-reflectors, and the reflected light is captured by the photoreceptor portion of the first photo-reflector and/or of the second photo-reflector, which are arranged on the printed circuit board so as to output two quadrature signals determining the direction of rotation of the stem.

9. The device according to claim 7, wherein the through openings or the reflective portions are evenly distributed on a circular rim inside the disc.

10. The device according to claim 8, wherein the through openings or the reflective portions are evenly distributed on a circular rim inside the disc.

11. The device according to claim 9, wherein there are six angular sectors of 30° angle of through openings or of reflective portions, and each sector is separated by a space of 30° angle.

12. The device according to claim 10, wherein there are six angular sectors of 30° angle of through openings or of reflective portions, and each sector is separated by a space also of 30° angle.

13. The device according to claim 7, wherein the light emitting light source of the first photo-reflector is arranged inside a first housing of the first photo-reflector, the photoreceptor portion of the first photo-reflector is arranged inside a second housing of the first photo-reflector, the light emitting light source of the second photo-reflector is arranged inside a first housing of the second photo-reflector, and the photoreceptor portion of the second photo-reflector is arranged inside a second housing of the second photo-reflector.

14. The device according to claim 8, wherein the light emitting light source of the first photo-reflector is arranged inside a first housing of the first photo-reflector, the photoreceptor portion of the first photo-reflector is arranged inside a second housing of the first photo-reflector, the light emitting light source of the second photo-reflector is arranged inside a first housing of the second photo-reflector, and the photoreceptor portion of the second photo-reflector is arranged inside a second housing of the second photo-reflector.

15. The device according to claim 7, wherein the stem comprises a tubular-shaped sliding pinion mounted at an inner end of the stem for meshing with a toothed wheel connected to the rotating arbor of the disc in the third position of the stem in order to rotate the disc during the rotation of the stem.

16. The device according to claim 8, wherein the stem comprises a tubular-shaped sliding pinion mounted at an inner end of the stem for meshing with a toothed wheel connected to the rotating arbor of the disc in the third position of the stem in order to rotate the disc during the rotation of the stem.

* * * * *